US005096179A

United States Patent [19]

Schmitt

[11] Patent Number: 5,096,179

[45] Date of Patent: Mar. 17, 1992

[54] SHEET-FEEDER FOR SUPPLYING A STREAM OF SINGLE SHEETS TO A SHEET-PROCESSING MACHINE

[75] Inventor: Karl-Heinz Schmitt, Sandhauser, Fed. Rep. of Germany

[73] Assignee: Heidelberger Druckmaschinen AG, Heidelberg, Fed. Rep. of Germany

[21] Appl. No.: 497,449

[22] Filed: Mar. 22, 1990

[30] Foreign Application Priority Data

Mar. 28, 1989 [DE] Fed. Rep. of Germany ..... 3910041

[51] Int. Cl.[5] ..... B65H 3/44

[52] U.S. Cl. ..... 271/9; 271/12; 271/270; 271/275; 414/795.8

[58] Field of Search ..... 414/795.4, 795.8, 797; 271/9, 94, 110, 111, 158, 202, 12, 270, 275

[56] References Cited

U.S. PATENT DOCUMENTS

| | | | |
|---|---|---|---|
| 3,334,891 | 8/1967 | Clausen et al. | 271/9 |
| 3,383,104 | 5/1968 | Laybourn | 271/9 |
| 3,914,154 | 10/1975 | Pfeiffer | 271/9 |
| 4,288,274 | 9/1981 | Holz | 271/9 |
| 4,311,379 | 1/1982 | Falomo | 271/9 |
| 4,565,478 | 1/1986 | Ericsson | 414/795.8 |
| 4,678,173 | 7/1987 | Basinger et al. | 271/9 |
| 4,703,924 | 11/1987 | Marass | 271/9 |

FOREIGN PATENT DOCUMENTS

| | | | |
|---|---|---|---|
| 037427 | 10/1981 | European Pat. Off. . | |
| 145848 | 1/1981 | Fed. Rep. of Germany . | |
| 3401724 | 8/1985 | Fed. Rep. of Germany . | |
| 2609428 | 7/1988 | France | 414/795.8 |
| 269662 | 1/1926 | United Kingdom . | |
| 2153793 | 8/1983 | United Kingdom . | |

*Primary Examiner*—Robert P. Olszewski
*Assistant Examiner*—Steven M. Reiss
*Attorney, Agent, or Firm*—Nils H. Ljungman & Associates

[57] ABSTRACT

A sheet feeder for the supplying of stream of single sheets to a sheet-processing machine. Preferably, a pile of sheets is carried by a pile table to a sheet-singling apparatus. The sheet-singling apparatus transfers a continuous stream of individual sheets, via a conveying table, to the sheet-processing machine. The invention allows for an extension of the time for changing the pile of sheets, due to the fact that a pile of sheets is provided on either side of the machine.

21 Claims, 5 Drawing Sheets

SHEET-FEEDER FOR SUPPLYING A STREAM OF SINGLE SHEETS TO A SHEET-PROCESSING MACHINE

BACKGROUND OF THE INVENTION

1. Field of the Invention

The present invention relates to a paper sheet feeder for supplying a stream of single, paper, cardboard, cardstock or the like, sheets to a sheet-processing machine. With the present invention, individual sheets of paper from a pile of sheets are carried by a pile table and the uppermost sheets are supplied, singly, and in a stream, by a sheet-singling apparatus, from a conveying table to the sheet-processing machine.

2. Background Information

German Laid Open Patent Application No. 34 01 724, which corresponds to U.S. Pat. No. 4,618,135, describes a temporary-pile apparatus that is provided for the continuous operation of a sheet-processing machine, such as a printing press. The purpose of this temporary-pile apparatus is to supply the machine with sheets, from the temporary-pile apparatus, when the main pile table is empty, until a new pile of sheets has been moved into position on the main pile table, so that uninterrupted production can continue. To accomplish that, an operator must always deposit a small pile of sheets, by hand, on the temporary-pile table. Because of the continuous-stream type of sheet supply, however, with the above described temporary-pile apparatus it is possible to produce an uninterrupted continuous stream of sheets only when a switch is made from the temporary-pile apparatus to the full pile of sheets. The continuous-stream supply of sheets must, however, be interrupted when a switch is made from the empty main pile to the temporary pile.

A further disadvantage of known designs is that the temporary pile is only small in height. If thin, paper sheets are being processed in the machine, the number of sheets in the temporary pile will be sufficient for the changing and moving-into-position of a new pile of sheets. If, however, sheet stock of thick cardboard, for example, is being processed on the machine, there will be only a few sheets on the temporary-pile table and, at full machine output, these will be consumed in a very short space of time that is not sufficient for changing the pile. The machine must, therefore, be stopped or must be operated at a considerably reduced speed for the time it takes to change the pile.

If, for example, carboard with a sheet thickness of 1 mm is being processed and the machine requires, for example, 180 sheets per minute at full machine output, a temporary pile with a height of 18 cm would maintain the supply of sheets for only one minute. This short time, however, will not normally be sufficient to change the pile and to position it in the machine. Often, the piles of sheets must be brought to the machine from remote storage locations, with it not being possible, owing to the high weight of the pile of sheets, to accomplish this in just a few seconds. Also, in the case of larger sizes of sheet, a considerable expenditure of effort is required from the machine operator if, for example, he has to deposit and correctly align a 20 cm thick pile of sheets on the temporary-pile table.

OBJECT OF THE INVENTION

One object of the present invention, therefore, is to design a sheet feeder that is also capable of processing thick sheet stock, such as cardboard, in such a manner that the operator has sufficient time to change a pile of sheets without interrupting the operation of the machine.

SUMMARY OF THE INVENTION

That object is achieved with the present invention in that the sheet-singling apparatus is positioned to deliver sheets transverse to the direction that the sheets enter the printing machine. A tape table, on which a pile of sheets is positioned, is located outside of the printing machine and has two sheet storage pile locations, one on either side of the printing machine. Both locations are outside the side frames of the printing machine and provide a continuous stream of sheets, alternately from each of the piles of sheets, along the tape table, and to the sheet-singling apparatus. The advantage of this design is that it is possible for full piles of sheets to be moved into the sheet feeder by means of the appropriate conveying equipment without it being necessary for piles of sheets to be deposited manually by the operator. Furthermore, until the height of a full pile of sheets has been consumed, there is sufficient time, even in the case of thick stock, to move out the empty pile table and to move in a new pile board with a full pile of sheets, with the result that it is also possible, for example, for preparatory operations to be performed for changing the pile.

The present invention guarantees that there is an uninterrupted, continuous supply of sheets when making a switch from one pile to the other without the continuous-stream formation being interrupted.

One aspect of the invention resides broadly in a sheet feeding device for feeding a machine with sheets of paper, cardstock, cardboard or the like. The sheet feeding device includes first and second sheet suppliers for supplying the sheets to be fed to the machine and a sheet transferer for being mechanically connected to the machine to be fed the sheets and the sheet transferer for being mechanically connected to the first and second sheet supply means, the sheet transfer is for receiving the sheets from the first and second sheet suppliers and for transferring the sheets to the machine to be fed the sheets. The first sheet supplier is configured to supply the sheets to the sheet transferer in a generally first direction. The second sheet supplier is configured to supply the sheets to the sheet transferer in a generally second direction with the second direction being generally opposite the first direction. Further, the sheet transferer is configured to supply the sheets to the machine to be fed the sheets in generally a third direction with the third direction being generally perpendicular to the first and second directions.

BRIEF DESCRIPTION OF THE DRAWINGS

The following Detailed Description of the Preferred Embodiment may be better understood when taken in conjunction with the appended drawings, in which.

DESCRIPTION OF THE PREFERRED EMBODIMENT

Figure 1:
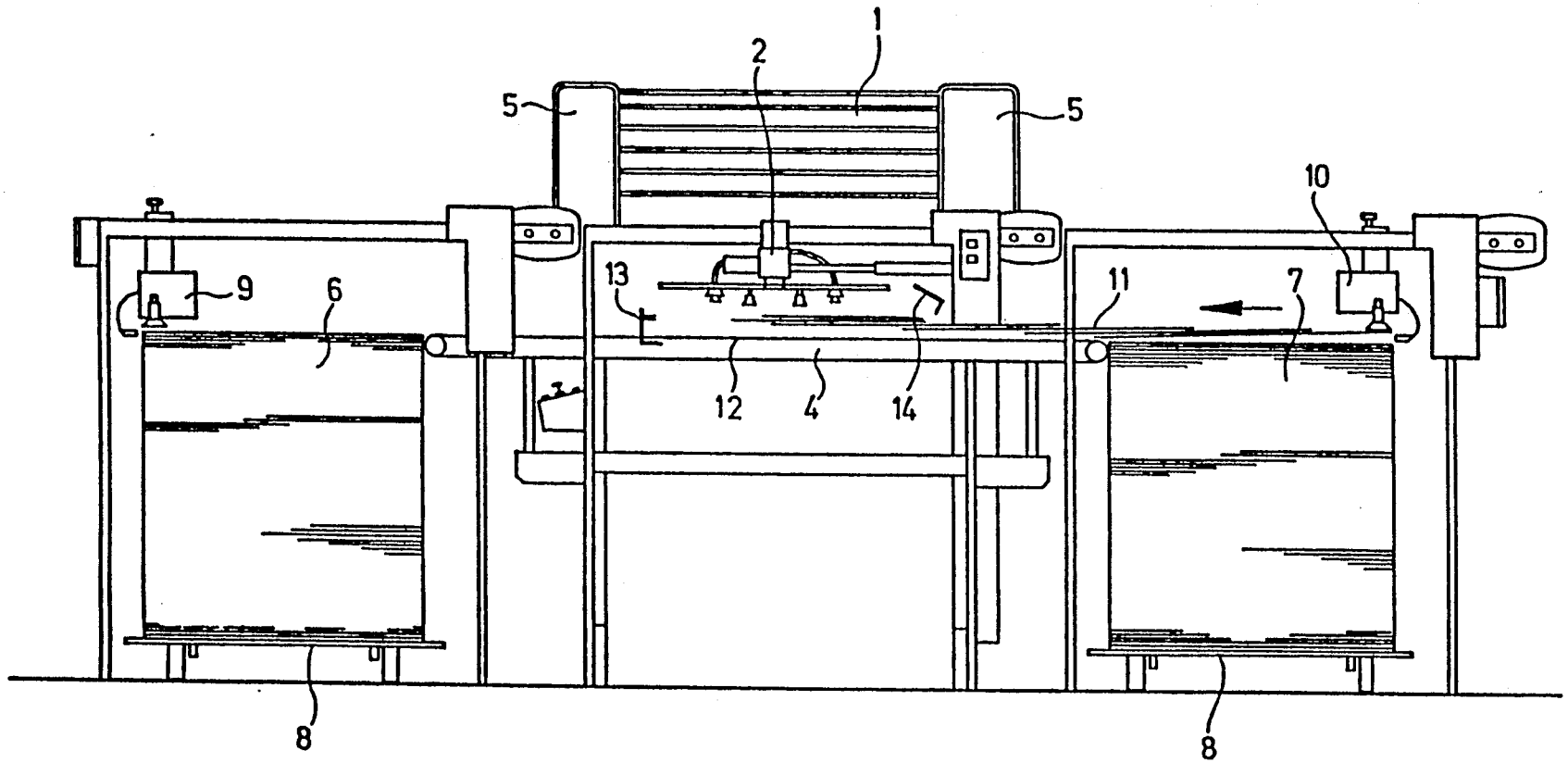
FIG. 1 is a front elevational view of a sheet feeder of the present invention.
Figure 2:
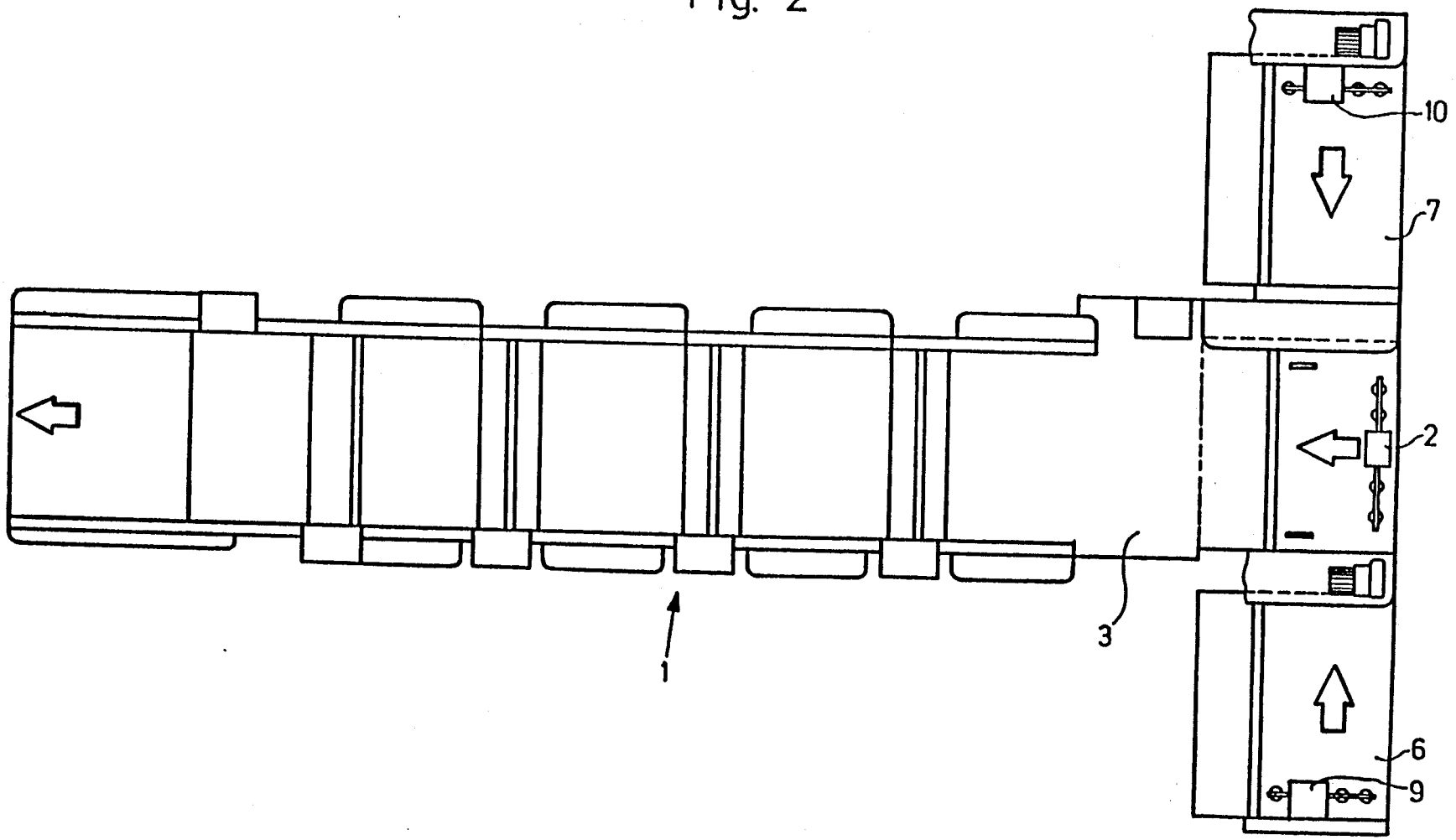
FIG. 2 is a top view of the sheet feeder of FIG. 1 and a top view of a printing press.

In a preferred embodiment as shown in FIGS. 1–6, the sheet feeder has been positioned to operate in conjunction with printing press, or sheet processing machine, 1. Such sheet feeders can, however, also be used in conjunction with punching, embossing and other sheet-processing machines. In any application, the uppermost sheet is supplied by sheet-singling apparatus 2, along conveying table 3 to sheet-processing machine 1, as seen in FIG. 2.

In the embodiment shown, sheet-singling apparatus 2 is positioned adjacent tape table 4, which extends transversely with respect to machine 1. Positioned on extensions of tape table 4 are piles of sheets 6 and 7. Piles 6 and 7 are positioned on both sides and outside of machine side frames 5. Each pile of sheets, 6 and 7, is deposited on one of pile tables 8 and can be transported and moved onto tables 8 by means of suitable lifting equipment. Each pile of sheets, 6 and 7, is assigned one of suction heads 9 and 10, by which the uppermost sheets of each pile of sheets, 6 and 7, are suction-gripped and are moved horizontally to tape table 4. The operating principle is shown on the right-hand side in FIG. 1, with suction head 10 forming a continuous stream of sheets 11, which is supplied via tape table 4 to sheet-singling apparatus 2.

The conveying direction of transport tapes 12, guided across tape table 4, is reversible, with the result that the continuous stream of sheets 11 is conveyed from the respective pile of sheets, 6 and 7, to retractable stops 13 and 14. In the embodiment shown in FIG. 1, the stream of sheets 11 is supplied to and aligned with stops 13. Sheet-singling apparatus 2 supplies the uppermost sheets at an angle of 90° in a continuous stream to conveying table 3 as shown in FIG. 2.

Figure 3:
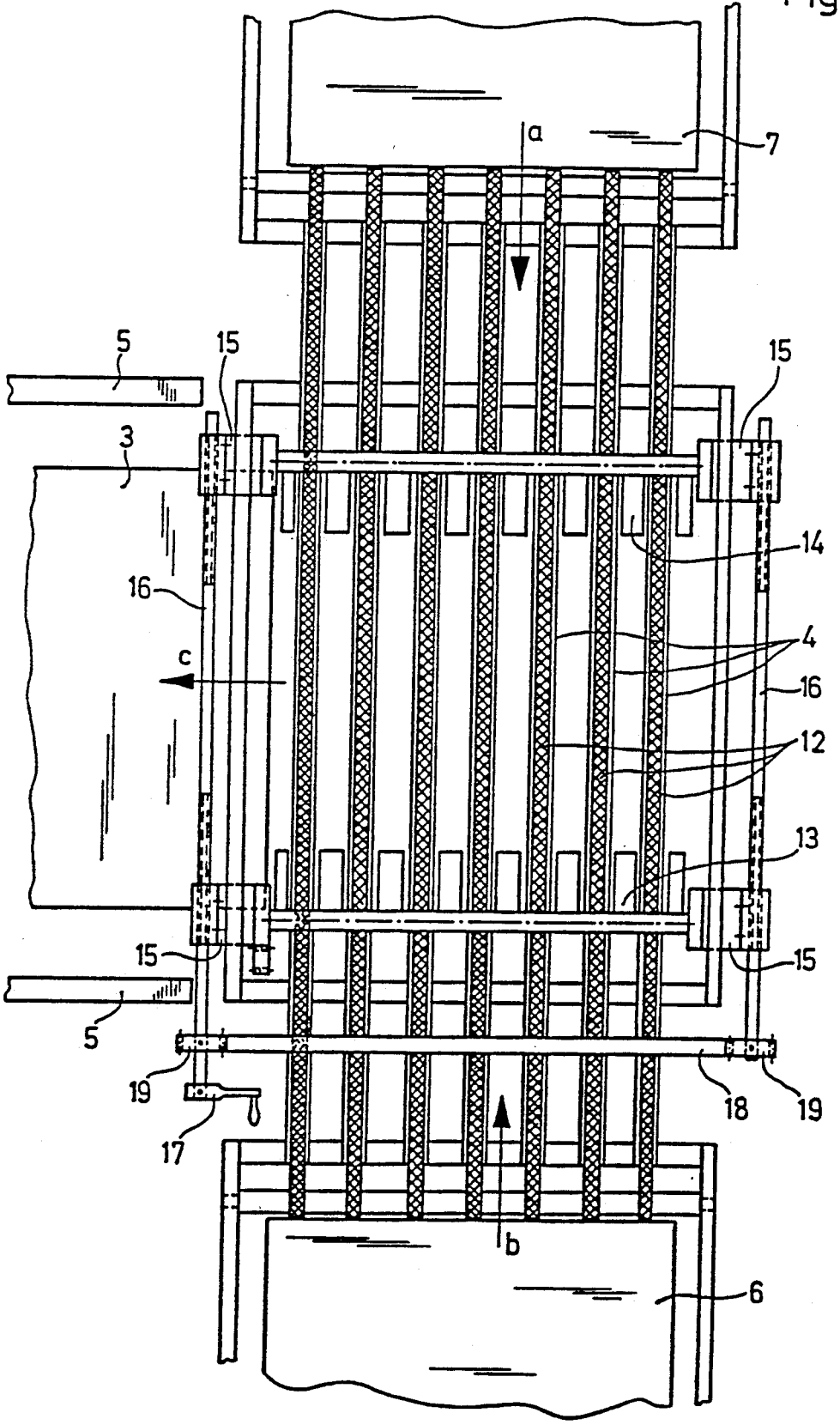
FIG. 3 is a top view of the tape table employed with the sheet feeder of FIG. 1.

FIG. 3 shows tapes 12, which are reversibly driven in their conveying direction. When sheets are conveyed from pile 7, the conveying direction of tapes 12 corresponds to the direction of arrow a. When the sheets are taken from pile 6, the conveying direction of tapes 12 corresponds to the direction of arrow b. In the case of conveying in direction a, stops 13 are retracted and stops 14 are in their rest position. In the case of conveying in direction b, stops 14 are in their working position. From here, the uppermost sheets are then supplied at an angle of 90° in a continuous stream to conveying table 3 and then move in direction c. According to the respective size of sheet, stops 13 and 14 are displaceably held in mounts 15 and can be adjusted by means of threaded spindles 16. Adjustment is accomplished in simple manner by means of hand crank 17, with both threaded spindles 16 being synchronized, for example, by means of toothed belt 18 and gearwheels 19.

Figure 4:
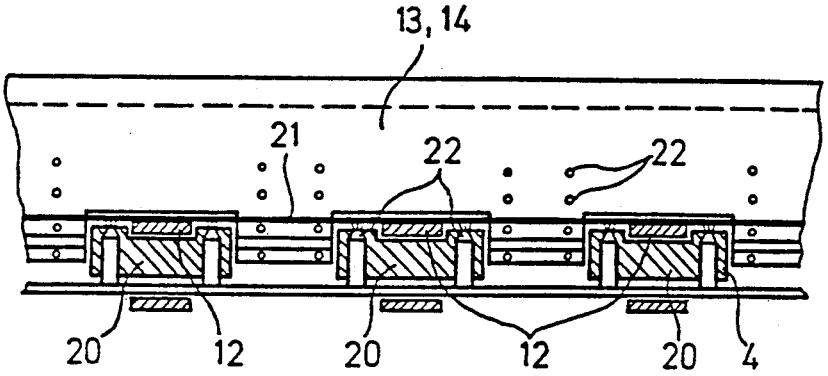
FIG. 4 is a partial cross-sectional side elevational view of the tape table of FIG. 3.

As shown in FIG. 4, tape table 4 comprises carrying rails 20, which accommodate tapes 12 and which transport sheets 21 to stops 13 and 14. Blow-air openings 22 are provided in carrying rails 20 and in stops 13 and 14. Air from blow-air opening 22 assists in the conveying of sheets 21.

Figure 5:
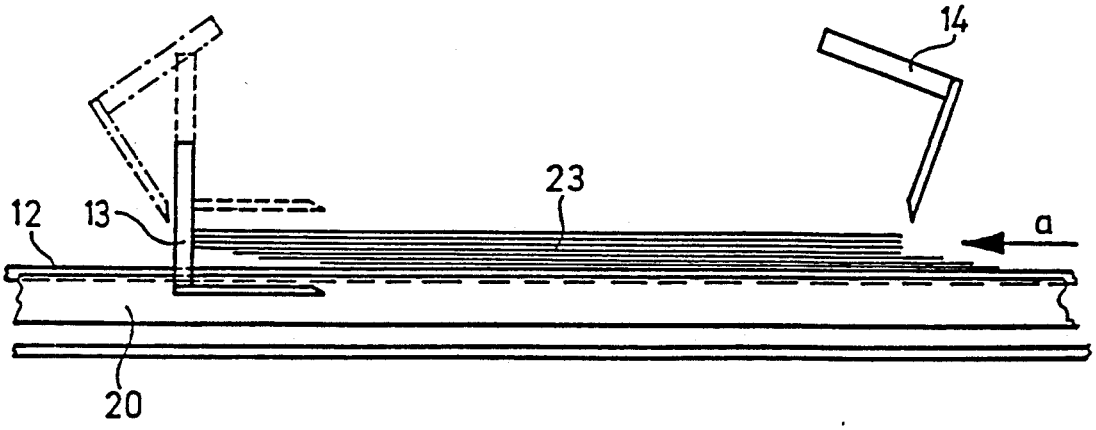
FIG. 5 is a partial front elevational view of the stop mechanism employed in the sheet feeder of FIG. 1.

In FIG. 5, the last sheets of the right-hand pile are supplied from the right, in the direction of arrow a. An automatic sensor may be provided to monitor the supply of sheets on the pile or a person may monitor the supply. These sheets are supplied at an increased speed, so that temporary pile 23 is formed. Temporary pile 23 comes up against stops 13, while stops 14 remain in their retracted position. As soon as the last sheet is in contact with stop 13, stop 14 is swivelled downwards in its working position. Stop 13 is then raised vertically, and without rotation, into the position shown by the broken line, with the result that temporary pile 23 is raised from the bottom on the left. Tapes 12 are then reversed, resulting in the sheets being supplied in a continuous stream from the left-hand pile. If an automatic sheet supply monitor were being employed, then that changeover action, from one pile to the other would be initiated by the automatic system. If, however, a person were monitoring the stack supply, then that person would initiate the changeover action, from one pile to the other manually. As a result of the raised position of temporary pile 23, the sheets that are supplied, in a continuous stream, are able to move under temporary pile 23 as far as stop 14. As soon as the latter has been reached, stop 13 swivels, or rotates, into the rest position indicated by the dash-dotted line. As soon as the sheets from the left-hand pile have reached stop 14, their speed of supply is reduced in such a manner that temporary pile 23 is carried away again. When a switch is being made from the left-hand pile to the right-hand pile, the procedure is performed in the reverse sequence.

Figure 6:
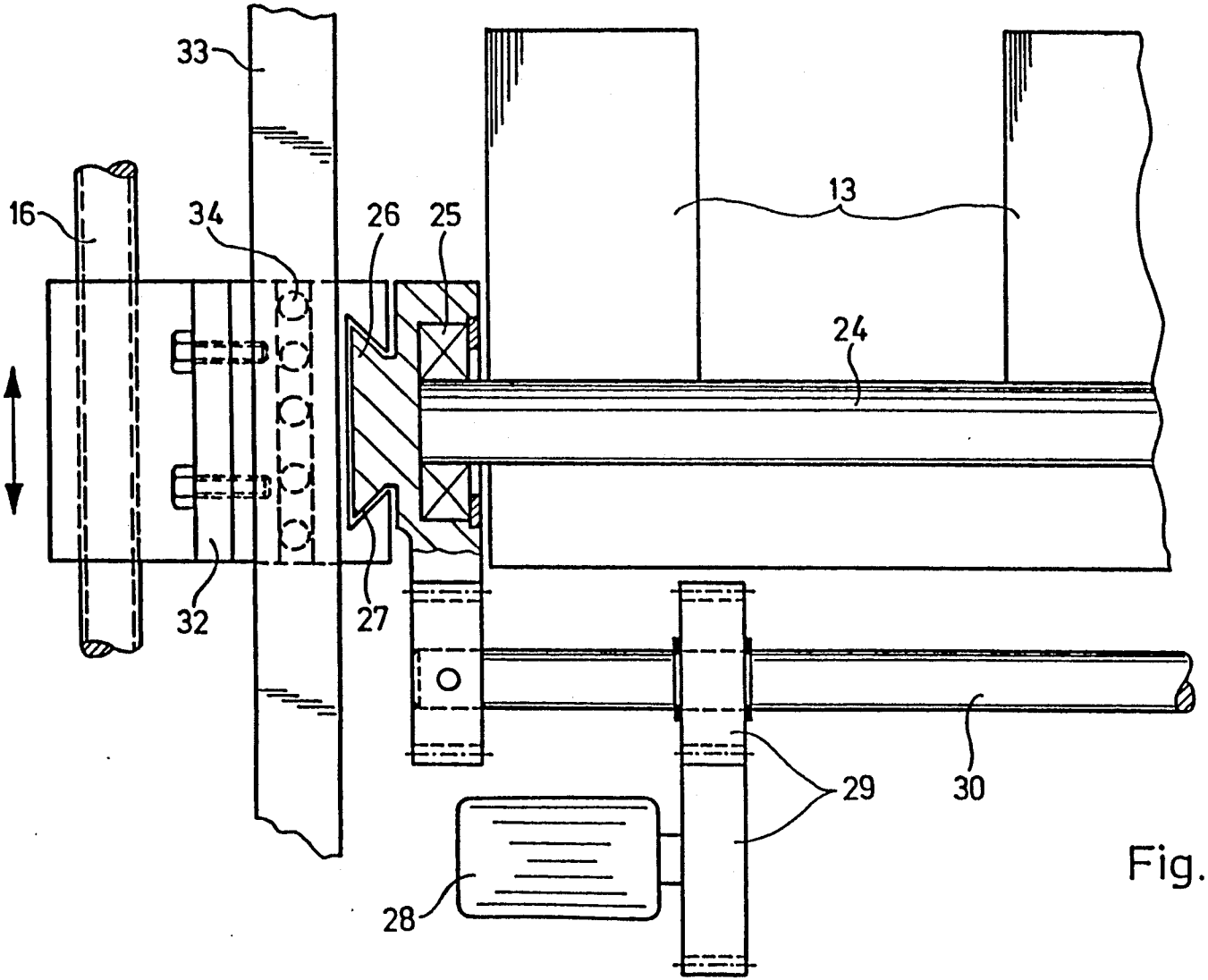
FIG. 6 is a partial detailed view of the stop mechanism of FIG. 5.

As is shown in FIG. 6, stops 13 are attached to cross-member 24, which is rotatably held by means of ball bearing 25. By means of a control (not shown) it is possible to control the swivelling movement of stops 13 and 14. Ball bearing 25 is disposed in sliding bearing 26, which is vertically displaceable by means of dovetail guide 27. The vertical displacement is effected on both sides simultaneously by motor 28, which, through the intermediary of gearwheel pair 29, drives connecting shaft 30. Shaft 30 is supported on both sides by spur gears 31 (one shown) and moves sliding bearing 26 in dovetail guide 27. Dovetail guide 27 is positioned in plain bearing 32, which is able to slide on cross-member 33 and is moved by threaded spindle 10 in order to adjust stops 13 and 14 according to the size of paper being processed. For ease of adjustment of plain bearing 32, plain bearing 32 is held on ball guide 34.

Instead of tape table 4, it is also possible to select a different transport apparatus, such as grippers, which grip the sheet and move it into a defined position. In this connection, it is also possible for a pile table to be disposed in front of the machine.

In summary, one feature of the invention resides broadly in a sheet feeder for the supplying of a stream of sheets, consisting of singled sheets, to a sheet-processing machine, in which a pile of sheets is carried by a pile table and in which the uppermost sheets can be supplied, singled into a stream of sheets by a sheet-singling apparatus, via a conveying table to the sheet-processing machine, characterized in that the sheet-singling apparatus 2 is assigned, transverse to the machine 1, a tape table 4, in the extension of which tape table 4 a pile of sheets 6, 7 is provided on either side outside of the machine side frames 5 and in that a continuous stream of sheets 11 is supplied alternately from the piles of sheets 6, 7 via the tape table 4 to the sheet-singling apparatus 2.

Another feature of the invention resides broadly in a sheet-feeder which is characterized in that the conveying direction of the transport tapes 12, guided across the tape table 4, is reversible, and the continuous stream of sheets 11 from the respective pile of sheets 6, 7 is conveyed to retractable stops 13, 14, such that the sheet-singling apparatus 2 supplies the uppermost sheets at an angle of 90° in a continuous stream to the conveying table 3.

Yet another feature of the invention resides broadly in a sheet-feeder which is characterized in that the two piles of sheets 6, 7 are assigned suction apparatuses 9, 10 for the singling of the uppermost sheets.

A further feature of the invention resides broadly in a sheet-feeder which is characterized in that each time before a switch is made from one to the other pile of sheets 6, 7, the last-conveyed sheets 21 are conveyed at increased speed, so that a temporary pile 23 is formed under the sheet-singling apparatus 2, said temporary pile 23 being raised by a small amount from the stop 13, 14, and in that the sheets then supplied in a continuous stream from the other pile of sheets 6, 7 are conveyed under the temporary pile, with the speed of supply of the newly supplied sheets then being reduced such that the temporary pile 23 is carried away.

A yet further feature of the invention resides broadly in a sheet-feeder which is characterized in that the two stops 13, 14 are adjustable in their distance from one another in order to suit the size of sheet being processed.

Yet another feature of the invention resides broadly in a sheet-feeder which is characterized in that the tape table 4 consists of carrying rails 20 for the tapes 12 and in that blow-air openings 22 are provided in the carrying rails 20 and in the stops 13, 14, such that the blow-air assists the conveying of the sheets 21 that are to be transported.

An additional feature of the invention resides broadly in a sheet feeder for the supplying of a stream of sheets, consisting of singled sheets, to a sheet processing machine in which a pile of sheets is carried by a pile of table and the upper most sheet can be supplied, singled into a stream of sheets by a sheet singling apparatus, via a belt table to the sheet processing machine is characterized by the fact that the sheet singling apparatus 2 is assigned transverse the machine 1, a belt table 4, an extension of which 4 a stack of sheets 6, 7 is provided on either side outside of the machine side frames 5 and that a continuous stream of sheets 11 is supplied alternately from the stacks of sheets 6, 7 via the belt table 4 to the sheet singling device 2, supplies the uppermost sheets at an angle of 90° in a continuous stream to the conveyor table 3 and that suction apparatuses 9, 10 are assigned to the two stacks of sheets 6, 7 for the singling of the uppermost sheets.

A yet additional feature of the invention resides broadly in a sheet feeder which is characterized in that each time before a switch is made from one to the other pile of sheets 6, 7, the last-conveyed sheets 21 are conveyed at increased speed, so that a temporary pile 23 is formed under the sheet-singling apparatus 2, said temporary pile 23 being raised by a small amount from the stop 13,14, and in that the sheets then supplied in a continuous stream from the outer pile of sheets 6,7 are conveyed under the temporary pile, with the speed of supply of the newly supplied sheets then being reduced such that the temporary pile 23 is carried away.

A further additional feature of the invention resides broadly in a sheet feeder which is characterized in that the two stops 13,14 consists of carrying rails 20 for the tapes 12 and in that blow-air openings 22 are provided in the carrying rails 20 and in the stops 13,14, such that the blow-air assists the conveying of the sheets 21 that are to be transported.

A yet further additional feature of the invention resides broadly in a sheet feeder which is characterized in that the tape table 4 consists of carrying rails 20 for the tapes 12 and in that blow-air openings 22 are provided in the carrying rails 20 and in the stops 13,14, such that the blow-air assists the conveying of the sheets 21 that are to be transported.

Some examples of components of printing presses can be found in U.S. Pat. No. 4,886,261, entitled "Sheet Feeder For A Printing Machine"; U.S. Pat. No. 4,738,442, entitled "Device For Monitoring Sheet Transport In A Feeder Of A Printing Machine"; U.S. Pat. No. 4,702,469, entitled "Apparatus And Method For Aligning Sheets"; U.S. Pat. No. 4,697,804, entitled "Sheet Feeder For Rotary Printing Machines"; U.S. Pat. No. 4,690,394, entitled "Stack Stop Assembly On A Sheet Feeder Of A Printing Press"; U.S. Pat. No. 4,642,455, entitled "Circuit Arrangement Using For A Light Barrier For Detecting Sheet-Feeding Faults In A Printing Press"; U.S. Pat. No. 4,635,924, entitled "Sheet Feeder For A Sheet-Processing Machine"; U.S. Pat. No. 4,635,925, entitled "Feeding Device For Sheet Processing Machines"; U.S. Pat. No. 4,624,454, entitled "Sheet Feeder For Printing Machines"; U.S. Pat. No. 4,615,520, entitled "Apparatus And Method For Aligning Sheets"; U.S. Pat. No. 4,184,674, entitled "Monitoring Device For Missing And Skewed Sheets In Sheet Feeds"; U.S. Pat. No. 4,090,702, entitled "Suction Air Control Device For Use With Sheet Feeds"; U.S. Pat. No. 3,986,713, entitled "Sheet Feeding Apparatus Having Traveling Feed Grippers"; U.S. Pat. No. 3,394,509, entitled "Control Device For The Lateral Stop On The Feed Table Of Sheet Feeds For Feeding Individual Sheets"; U.S. Pat. No. 3,938,800, entitled "Suction Head For Sheet Feeding Apparatus"; U.S. Pat. No. 4,432,539, entitled "Sheet Feeding System For Printing Machines"; U.S. Pat. No. 4,883,378, entitled "Control System For Sheet-Feeding Device For Printing Apparatus"; U.S. Pat. No. 4,881,837, entitled "Automatic Sheet Feeder"; U.S. Pat. No. 4,863,153, entitled "Control System For Sheet-Feeding Device For Printing Apparatus"; and U.S. Pat. No. 4,433,426, entitled "Control System For Printing Machines."

All, or substantially all, of the components and methods of the various embodiments may be used with at least one embodiment or all of the embodiments, if any, described herein.

All of the patents, patent applications, and publications recited herein, if any, are hereby incorporated by reference as if set forth in their entirety herein.

The details in the patents, patent applications, and publications may be considered to by incorporable, at applicant's option, into the claims during prosecution as further limitations in the claims to patentably distinguish any amended claims from any applied prior art.

The invention as described hereinabove in the context of the preferred embodiments is not to be taken as limited to all of the provided details thereof, since modifications and variations thereof may be made without departing from the spirit and scope of the invention.

What is claimed is:

1. Sheet feeding apparatus for feeding a machine with sheets of paper, cardstock, cardboard or the like, said sheet feeding apparatus comprising:

first and second means for holding the sheets to be fed to the machine;

first sheet supply means for supplying the sheets from the first sheet holding means to the machine;

second sheet supply means for supplying the sheets from the second sheet holding means to the machine;

said first and second sheet supply means comprising common sheet transfer means for further supplying the sheets to be fed to the machine;

said sheet transfer means for being mechanically connected to the machine to be fed the sheets;

said sheet transfer means being mechanically connected to said first and second sheet supply means;

said sheet transfer means for receiving the sheets from said first and second sheet supply means;

said sheet transfer means for transferring the sheets to the machine to be fed the sheets;

said first sheet supply means configured to supply the sheets to said sheet transfer means in a generally first direction;

said second sheet supply means configured to supply the sheets to said sheet transfer means in a generally second direction, said second direction being generally different from said first direction;

said sheet transfer means configured to supply the sheets to the machine to be fed the sheets in generally a third direction, said third direction being generally perpendicular to at least one of said first and second directions;

means for accumulating a temporary pile of sheets supplied from at least one of said first and second sheet supply means; and means for separating and feeding sheets one at a time from the temporary pile of sheets to the machine, said sheet separating and feeding means being positioned adjacent said sheet transfer means.

2. The apparatus of claim 1, wherein said second direction is generally opposite said first direction.

3. The apparatus of claim 2, wherein said sheet transfer means in interposed between said first sheet holding means and said second sheet holding means.

4. The apparatus of claim 3, wherein:

the machine to feed the sheets defines a first side and a second side, said first side opposes said second side;

said first sheet holding means is positioned outside the machine and adjacent said first side of the machine; and said second sheet holding means is positioned outside the machine and adjacent said second side of the machine.

5. The apparatus of claim 4, wherein said sheet transfer means comprises belt table means for feeding the sheets to the machine.

6. The apparatus of claim 5, wherein said means for accumulating a temporary pile of sheets comprises stop means for stopping and at least partially lifting the sheets to be fed to the machine.

7. The apparatus of claim 6, wherein said sheet transfer means is configured to alternately receive sheets from said first sheet supply means and said second sheet supply means.

8. The apparatus of claim 7, wherein said stop means comprises:

a first stop for stopping and at least partially lifting at least a portion of the sheets supplied by said first sheet supply means; and a second stop for stopping and at least partially lifting at least a portion of the sheets supplied by said second sheet supply means.

9. The apparatus of claim 8, wherein said first and second sheet supply means each are configured to supply the sheets to said sheet transfer means at least two rates of speed.

10. The apparatus of claim 9, wherein said sheet transfer means further comprises air port means for blowing air against the fed sheets to facilitate said feeding of the sheets to the machine.

11. The apparatus of claim 2, wherein:

said apparatus is configured to hold a pile of sheets to be fed to the machine; and said sheet feeding means is for separating individual sheets from the pile of sheets to be fed to the machine.

12. The apparatus of claim 1, wherein said sheet transfer means is interposed between said first sheet holding means and said second sheet holding means.

13. The apparatus of claim 1, wherein:

the machine to feed the sheets defines a first side and a second side;

said first side opposes said second side;

said first sheet holding means is positioned outside the machine and adjacent said first side of the machine; and said second sheet holding means is positioned outside the machine and adjacent said second side of the machine.

14. The apparatus of claim 1, wherein said sheet transfer means comprises belt table means for feeding the sheets to the machine.

15. The apparatus of claim 1, wherein said sheet transfer means is configured to alternately receive sheets from said first sheet supply means and said second sheet supply means receiving said supplied sheets.

16. Sheet feeding apparatus for feeding a machine with sheets of paper, cardstock, cardboard or the like, said sheet feeding apparatus comprising:

first and second means for holding the sheets to be fed to the machine;

first sheet supply means for supplying the sheets from the first sheet holding means to the machine;

second sheet supply means for supplying the sheets from the second sheet holding means to the machine;

said first and second sheet supply means comprising common sheet transfer means for further supplying the sheets to be fed to the machine;

said sheet transfer means for being mechanically connected to the machine to be fed the sheets;

said sheet transfer means being mechanically connected to said first and second sheet supply means;

said sheet transfer means for receiving the sheets from said first and second sheet supply means;

said sheet transfer means for transferring the sheets to the machine to be fed the sheets;

said first sheet supply means configured to supply the sheets to said sheet transfer means in a generally first direction;

said second sheet supply means configured to supply the sheets to said sheet transfer means in a generally second direction, said second direction being generally different from said first direction;

said sheet transfer means configured to supply the sheets to the machine to be fed the sheets in generally a third direction, said third direction being generally perpendicular to at least one of said first and second directions; and stop means for stopping and at least partially lifting the sheets to be fed to the machine.

17. The apparatus of claim 16, wherein said second direction is generally opposite said first direction.

18. The apparatus of claim 17, wherein said stop means comprises:

a first stop for stopping and at least partially lifting at least a portion of the sheets supplied by said first sheet supply means; and a second stop for stopping and at least partially lifting at least a portion of the sheets supplied by said second sheet supply means.

19. Sheet feeding apparatus for feeding a machine with sheets of paper, cardstock, cardboard or the like, said sheet feeding apparatus comprising:

first and second means for holding the sheets to be fed to the machine;

first sheet supply means for supplying the sheets from the first sheet holding means to the machine;

second sheet supply means for supplying the sheets from the second sheet holding means to the machine;

said first and second sheet supply means comprising common sheet transfer means for further supplying the sheets to be fed to the machine;

said sheet transfer means for being mechanically connected to the machine to be fed the sheets;

said sheet transfer means being mechanically connected to said first and second sheet supply means;

said sheet transfer means for receiving the sheets from said first and second sheet supply means;

said sheet transfer means for transferring the sheets to the machine to be fed the sheets;

said first sheet supply means configured to supply the sheets to said sheet transfer means in a generally first direction;

said second sheet supply means configured to supply the sheets to said sheet transfer means in a generally second direction, said second direction being generally different from said first direction;

said sheet transfer means configured to supply the sheets to the machine to be fed the sheets in generally a third direction, said third direction being generally perpendicular to at least one of said first and second directions; and said first and second sheet supply means each being configured to supply the sheets to said sheet transfer means at least two rates of speed.

20. The apparatus of claim 19, wherein said second direction is generally opposite said first direction.

21. The apparatus of claim 20, wherein said sheet transfer means further comprises air port means for blowing air against the fed sheets to facilitate said feeding of the sheets to the machine.

* * * * *

UNITED STATES PATENT AND TRADEMARK OFFICE

CERTIFICATE OF CORRECTION

PATENT NO. : 5,096,179
DATED : 03/17/92
INVENTOR(S) : SCHMITT

It is certified that error appears in the above-indentified patent and that said Letters Patent is hereby corrected as shown below:

Column 1, line 50, . . . delete "carboard" and insert "cardboard".

Column 8, line 37, . . .after "means" delete "receiving said supplied sheets.

Signed and Sealed this

Twenty-fifth Day of October, 1994

*Attest:*

*Attesting Officer*

Bruce Lehman

BRUCE LEHMAN

*Commissioner of Patents and Trademarks*

UNITED STATES PATENT AND TRADEMARK OFFICE

CERTIFICATE OF CORRECTION

PATENT NO. : 5,096,179

DATED : March 17, 1992

INVENTOR(S) : Karl-Heinz Schmitt

It is certified that error appears in the above-indentified patent and that said Letters Patent is hereby corrected as shown below:

On the title page, item [75] Inventor "Sandhauser" should read --Sandhausen--.

Signed and Sealed this

Sixth Day of December, 1994

*Attest:*

Bruce Lehman

BRUCE LEHMAN

*Attesting Officer*

*Commissioner of Patents and Trademarks*